US007690093B2

(12) United States Patent
Norgaard

(10) Patent No.: US 7,690,093 B2
(45) Date of Patent: Apr. 6, 2010

(54) ROLLER ARRANGEMENT FOR PRODUCING FLEECE

(75) Inventor: Raymond Norgaard, Pritzwalk (DE)

(73) Assignee: Concert GmbH, Pritzwalk (DE)

( * ) Notice: Subject to any disclaimer, the term of this patent is extended or adjusted under 35 U.S.C. 154(b) by 0 days.

(21) Appl. No.: 11/666,199

(22) PCT Filed: Nov. 3, 2005

(86) PCT No.: PCT/EP2005/055735

§ 371 (c)(1),
(2), (4) Date: Dec. 18, 2008

(87) PCT Pub. No.: WO2006/048437

PCT Pub. Date: May 11, 2006

(65) Prior Publication Data

US 2009/0119895 A1 May 14, 2009

(30) Foreign Application Priority Data

Nov. 5, 2004 (DE) ..... 10 2004 054 532
Nov. 17, 2004 (DE) ..... 10 2004 056 154

(51) Int. Cl.
*D04H 1/44* (2006.01)
*D04H 1/70* (2006.01)
*D06C 15/02* (2006.01)

(52) U.S. Cl. ..... 28/134; 28/135; 28/103

(58) Field of Classification Search ..... 28/116, 28/134, 135, 137, 103, 104, 105; 26/18.6; 162/357, 360.2, 360.3, 203, 205, 206, 305; 19/161.1, 296; 266/170, 171, 174, 179, 180, 266/95

See application file for complete search history.

(56) References Cited

U.S. PATENT DOCUMENTS

| | | | | | |
|---|---|---|---|---|---|
| 2,708,303 | A | * | 5/1955 | Walton | 28/122 |
| 2,881,505 | A | * | 4/1959 | Hoffman | 264/119 |
| 3,188,372 | A | * | 6/1965 | Roos | 264/287 |
| 3,220,057 | A | * | 11/1965 | Walton | 425/385 |
| 3,956,806 | A | * | 5/1976 | Casse | 26/20 |
| 4,483,745 | A | * | 11/1984 | Wicks et al. | 162/205 |
| 4,668,322 | A | * | 5/1987 | Christensen | 156/209 |

(Continued)

FOREIGN PATENT DOCUMENTS

DE 37 10407 10/1988

(Continued)

OTHER PUBLICATIONS

English language abstract of DE 697 11 931, Nov. 2002.

(Continued)

*Primary Examiner*—Amy B Vanatta
(74) *Attorney, Agent, or Firm*—Ware, Fressola, Van Der Sluys & Adolphson LLP

(57) ABSTRACT

The invention relates to an apparatus for producing non-woven, fleece-like fiber products, said apparatus comprising a transfer belt configured to transport an intermediate product on the underside of a transfer belt to a roller arrangement, said roller arrangement comprising four rotatable rollers that are arranged and configured to interact in pairs in constellations that can be selectively modified, wherein each of the four rollers has a rotational axis, and the four rotational axes run at least approximately parallel to each other.

19 Claims, 2 Drawing Sheets

U.S. PATENT DOCUMENTS

| | | | | |
|---|---|---|---|---|
| 4,809,404 | A | 3/1989 | Lasenga | |
| 6,007,653 | A * | 12/1999 | Pirinen et al. | 156/148 |
| 6,141,833 | A * | 11/2000 | Sørensen | 19/308 |
| 6,375,773 | B1 * | 4/2002 | Andersen | 156/148 |
| 6,673,204 | B2 * | 1/2004 | Takai et al. | 162/115 |
| 7,331,089 | B2 * | 2/2008 | Christensen | 28/103 |
| 2002/0092884 | A1 | 7/2002 | Fleissner | |
| 2008/0196207 | A1 * | 8/2008 | Dilo et al. | 19/163 |

FOREIGN PATENT DOCUMENTS

| | | |
|---|---|---|
| DE | 94 08 597 | 9/1995 |
| DE | 697 11 931 | 11/2002 |
| EP | 0 867 550 | 9/1998 |
| EP | 0 899 370 | 3/1999 |
| EP | 1 336 687 | 8/2003 |

OTHER PUBLICATIONS

English language abstract of EP 0 899 370, Mar. 1999.
English language abstract of EP 1 336 687, Aug. 2003.
English language translation of claim No. 1 of DE 94 08 597, Sep. 1995.
US 4,809,404 is US parallel case to DE 37 10407, (Oct. 1988).

* cited by examiner

ROLLER ARRANGEMENT FOR PRODUCING FLEECE

CROSS REFERENCE TO RELATED APPLICATIONS

This application is for entry into the U.S. national phase under §371 for International Application No. PCT/EP05/055735 having an international filing date of Nov. 3, 2005, and from which priority is claimed under all applicable sections of Title 35 of the United States Code including, but not limited to, Sections 120, 363 and 365(c), and which in turn claims priority under 35 USC §119 to German Patent Application No. 10 2004 056 154.0 filed on Nov. 17, 2004, and German Patent Application No. 10 2004 054 532.4 filed on Nov. 5, 2004.

BACKGROUND OF THE INVENTION

1. Technical Field

The invention relates to an apparatus in the form of an arrangement of rollers, in particular embossing rollers, and at least one conveyor belt in the form of a transfer belt, for fleece production and in particular for airlaid production. By the term airlaid production is meant the manufacturing of nonwoven, fleece-like fiber products with fiber lengths of up 50 millimeters.

2. Discussion of Related Art

In many cases, such products are intermediate products required for a wide range of final products such as sanitary towels, wiping cloths or absorbent material for the automotive industry. Nonwoven fabrics are produced from natural or synthetic fibers made of different material and with different staple lengths. A bonding agent such as Latex can be used to bond the fibers together. In the case of plastic fibers, bonding can also be effected by partially melting and fusing the fibers with each other. The nonwoven fabric to be produced—including the intermediate product—may have a multilayered structure. To provide the nonwoven fabric with a particularly high fluid uptake capacity, superabsorbent polymers in particle (SAP) or fiber form (SAF) can be added.

Suitable natural fibers include, for example, cellulose fibers from cotton, hemp or flax, or loosened wood cellulose that has already been mechanically or chemically treated (fluff pulp). Suitable plastic fibers, particularly matrix fibers used for bonding the nonwoven fabric, can contain polyester, polypropylene or viscose. Particularly suitable synthetic bonding fibers are bicomponent fibers, so called, which have a core made of a first material surrounded by a mantle made of a plastic, for example polyethylene, which allows the fibers to fused with each other and with natural and matrix fibers.

The range of desired densities of the product is heavily dependent on the final product for which the nonwoven fabric is to be used. The range of desired fleece densities is very large, therefore. The range of materials to be processed (see above) and the range of staple lengths of the single fibers is likewise very large.

The production of an airlaid nonwoven fabric of the kind involved here usually includes mixing the fibers in a forming head which is disposed above a forming belt in the form of an air-permeable conveyor belt, and which spreads the processed mixed fibers as uniformly as possible on the forming belt. Suction boxes, with which the fibers deposited on the forming belt are sucked onto the forming belt, are disposed underneath the forming belt. Downstream from the forming head, in the direction of the forming belt (also called a forming sieve), a compacting roller is generally provided which acts from above on the fiber-air mixture deposited on the forming belt and which pre-compresses said mixture. Air is pressed out of the fiber-air mixture in the process, with the result that the mixture decreases in thickness and increases in density. The fiber-air mixture pre-compacted in this manner is then transferred from a forming belt to a transfer belt which is located above the pre-compacted fiber-air mixture and is permeable to air, such that the fiber-air mixture is sucked onto the transfer belt from below by means of a suction box disposed above the transfer belt, and received by the forming belt. The transfer belt is used to feed the pre-compacted fiber-air mixture to the roller arrangement of interest here for further compaction of the fiber-air mixture into a fleece.

The roller arrangement of interest here is used to compact the fiber-air mixture and, in one preferred embodiment, to bring about the fusing of single fibers by heating the fiber-air mixture—possibly with simultaneous embossing of a structure—such that a nonwoven fabric is produced as an intermediate product with the desired properties.

This kind of apparatus described here is intended to be suitable for producing a wide range of products that, as described at the beginning, may differ considerably in their composition, and which accordingly require different kinds of treatment. For example, the amount of heat required to melt the fibers differs considerably depending on the composition of the fiber-air mixture and the desired thickness and density of the starting material. At the same time, steps should be taken to ensure, if possible, that the fiber-air mixture fed by the transfer belt is always in step and is further processed in a uniform manner and, in particular, is further compacted. During compaction, it is important to prevent wave-like variations in density occurring in the direction that the nonwoven fabric is conveyed, which may arise, for example, when the fiber material to be compacted periodically dams up in front of a roller pair that effects such compaction. One problem in this context consists, for example, in the fact that the air to be pressed out of the fiber-air mixture during compaction must escape in the direction opposite to the conveying direction. In the worst case, an air cushion is produced that can even lead to unwanted folds forming in the nonwoven fabric.

There is therefore a need for an apparatus that is suitable for producing a large range of products.

DISCLOSURE OF INVENTION

This need is met, according to the invention, by an apparatus of the kind initially specified, in which a roller arrangement is provided which comprises four rollers with rotational axes that are aligned approximately parallel to each other. A first of these four rollers is used as a deflection roller for a transfer belt. A second roller is located underneath the first roller and forms therewith a first pair of rollers arranged one above the other. A third roller is located downstream from the second roller, viewed in the running direction of the transfer belt, and a fourth roller is located downstream from the first roller, viewed in the running direction of the transfer belt. The rollers can be displaced relative to each other transversely to their rotational axis in such a manner that a nip for handling a nonwoven fabric can be selectively set between the second and the third rollers or between the third and the fourth rollers, such that, in the former case, the second and the third rollers form a pair of adjacently arranged rollers and include a nip for substantially vertical fleece transport, whereas in the latter case the third and the fourth roller positioned above it form a second pair of rollers arranged one above the other (in addition to the first pair of rollers arranged one above the other, in the form of the first and second rollers) and include a nip for substantially horizontal fleece transport.

The invention is based on the idea of enabling a maximum range of manufactured products by means of a special design of the roller arrangement disposed immediately downstream from the transfer belt. It has been found that the chosen approach to configuring this particular roller arrangement in a special manner is especially promising compared to alternative solutions, such as providing additional roller arrangements that are more distant from the transfer belt.

Depending on the type of nonwoven fabric to be made, the roller arrangement according to the invention allows a different transport path to be set, namely a transport path between the first and the second rollers and then through the second and third rollers, on the one hand, or a transport path between the first and second rollers and then between the third and fourth rollers. Hence, the roller pair downstream from the first roller pair arranged one above the other is either a roller pair arranged (substantially horizontally) adjacent each other, or a roller pair arranged (substantially vertically) one above the other. In this manner, the specific advantages of the one or other roller arrangement can be used alternatively.

One advantage of the former transport path is that the nonwoven fabric is supported by the second roller over a relatively large circumferential angle of 90°, for example. As a result, it is possible for a loose nonwoven fabric to be held together efficaciously in order to make a product with a low tensile strength of, for example, up to 5N/50 mm, according to the EDANA Recommended Test Method "Tensile Strength" 20.2-89. When the second roller is heated, furthermore, there is also a large area for transferring heat from the second roller to the fleece. The second transport path referred to above is a suitable alternative when the fleece supplied by the first pair of rollers disposed one above the other is strong enough to not require any distinct support for this nonwoven fabric. The advantage of the second transport path referred to above then consists in the fact that it easy for air to escape during compaction of the nonwoven fabric in the pair of rollers arranged one above the other and formed by the third and fourth rollers. The risk of folds forming is then less, on the whole.

In the case of the configuration according to the second transport path, air nozzles for compressed or suction air can be provided above or below the transport path between the first and the second pair of rollers arranged one above the other. These air nozzles can generate an upwardly directed stream of air extending across the entire width of the transport path, in order to support or guide or steer the loose nonwoven fabric along the second transport path between the first and the second pair of rollers arranged one above the other.

In this configuration, the respective roller pairs function as the kind of roller pairs also referred to as embossers.

The arrangement of roller pairs described in the foregoing makes it possible, in certain circumstances, to dispense with a compacting roller downstream from the forming head, as mentioned at the beginning.

The nip formed between two rollers of a roller pair can preferably be adjusted in various respects.

Firstly, in one variant of the invention, it is possible for one of the rollers in a roller pair to permit a slight skewing of its rotational axis relative to the rotational axis of the respective other roller in the roller pair, thus resulting in a nip that is narrower in the middle of the rollers, or which produces a greater pressing force than at the respective axial ends of the rollers.

A similar effect can be achieved in one particularly preferred variant of the invention, in which the third roller is preferably configured as a roller with controlled deflection or as a roller with variable cambering or crowning. Such a roller with controlled deflection is known as such and allows, in particular, a uniform nip pressure to be generated across the entire web width of the nonwoven fabric. By nip pressure is meant the curve of the pressing force in the axial direction of the nip parallel to the rotational axes of the rollers.

When, according to one particularly preferred embodiment, the third roller is configured as a roller with controlled deflection, it is advantageous when the direction of lateral deflection can be adjusted in such a manner that the deflection can be set selectively in a horizontal plane or in a vertical plane. A deflection in the horizontal direction is desirable when the third roller interacts with the second roller as a pair of adjacently arranged rollers, whereas deflection in the vertical direction is desirable when the third roller interacts with the fourth roller as a second pair of rollers arranged one above the other.

Other adjustment options that are preferably provided relate to the width of a respective nip, and/or the amount of the pressing force or nip pressure prevailing in each case. The latter pressure lies between 0 and 150 N/mm, preferably between 0.01 and 100 N/mm. Since this is a nip pressure, the dimensions are based on length, not on area.

In order to enable appropriate settings, the gap between the rotational axis of the first roller and the rotational axis of the second roller is preferably adjustable by arranging the first roller in such a manner that it is displaceable, preferably in a substantially vertical plane, in a direction transverse to its rotational axis. Since the first roller is also used as a deflecting roller for the transfer belt, it can be advantageous when the plane within which the first roller is transversely displaceable is slightly inclined relative to the vertical plane, such that the belt lengths are at least partially compensated when the first roller is displaced.

The expression "transversely displaceable" is understood throughout this description to mean a displacement of a roller in a direction that is transverse to the orientation of the respective rotational axis.

In another preferred variant of the invention, the third roller is arranged transverely displaceable in relation to the second roller, similar to the transversely displaceable arrangement of the first roller relative to the second roller, such that it is possible to adjust the gap between the two rotational axes and/or to adjust a corresponding nip pressure between the second and the third roller in the desired manner, when the second and third rollers interact as a pair of adjacently arranged rollers. It is preferable here that the third roller be transversely displaceable in a substantially horizontal plane.

The fourth roller, finally, is also preferably arranged in a transversely displaceable manner in a plane that is preferably at least approximately perpendicular, such that the gap between the fourth roller and the third roller and/or the nip pressure between these two rollers can be adjusted in the configuration in which the third and the fourth roller interact as a second pair of rollers arranged one above the other. In that case, the third roller transversely displaceable in the horizontal plane is preferably brought into a position in which the third roller is spaced further apart from the second roller than in the configuration in which the second and the third rollers interact as an adjacently arranged (horizontal) roller pair.

All four rollers can be embodied as plain rollers with a smooth outer mantle. The outer mantle is preferably formed in each case by a mantle made of metal, preferably of steel.

Depending on the product to be manufactured, individual rollers may be embodied as embossing rollers and accordingly have an outer mantle provided with indentations and raised portions corresponding to the desired embossing pattern. Only one of the two rollers in a roller pair is generally embodied as an embossing roller, whereas the respective other roller serves as a backing roller. Instead of a metal outer mantle, the respective backing roller may be provided with a plastic surface formed by a plastic coating on a metal base body.

The effect of the raised portions on the embossing rollers is that the fleece to be compacted is compacted more strongly in the region of the raised portions on the embossing rollers than in regions therebetween. Depending on the arrangement of the rollers and the kind of fiber mixture forming the nonwoven fabric, the fibers are fused together in those regions defined by the raised portions on the embossing roller. The raised portions preferably have a uniform pattern, for example in the form of a knobby pattern which causes compaction of the nonwoven fabric at discrete points. Other surface structures of the embossing roller can consist, for example, in rhombus-shaped indentations in the outer mantle, with webs inbetween.

The embossing rollers provided with a correspondingly structured surface are preferably the second and/or the fourth roller, such that the first roller and the third roller are configured as plain rollers or as backing rollers with plastic coating. The first roller, in particular, is preferably embodied as a roller with an elastic outer mantle (rubber roller).

Some of the rollers, preferably the second, the third and/or the fourth roller, can be heated, thus allowing the transfer of heat into the nonwoven fabric in contact with the respective roller. In this manner, the thermal bonding of fibers mentioned at the beginning can be effected by fusing single plastic fibers with each other and with natural and matrix fibers.

Finally, in addition to the roller arrangement described, a conveyor belt for receiving and for further conveying the nonwoven fabric treated by the roller arrangement is preferably provided, which receives the nonwoven fabric either underneath the nip formed by the second and third roller, in the case of the first transport path, or, in the case of the second transport path, downstream from the nip formed by the third and fourth rollers, viewed in the direction of transport.

For this purpose, the conveyor belt can have a belt portion that rises upwards in the direction of transport and which receives the nonwoven fabric below the nip formed by the second and third rollers, with a vertical conveying direction.

In one optional variant of the invention, the conveyor belt can adopt two alternative configurations, namely the aforementioned configuration and, alternatively, a configuration in which one deflecting roller for the conveyor belt is disposed immediately downstream from the third roller, viewed in the direction of transport, when the third roller forms a second pair of rollers arranged one above the other with the fourth roller, such that any nonwoven fabric conveyed in this case through the second nip with a horizontal feeding direction is moved onto the conveyor belt by the shortest path and preferably on the same horizontal plane as the second nip.

BRIEF DESCRIPTION OF THE DRAWINGS

The invention shall now be explained in greater detail with reference to the Figures, in which.

DETAILED DESCRIPTION

Figure 1:
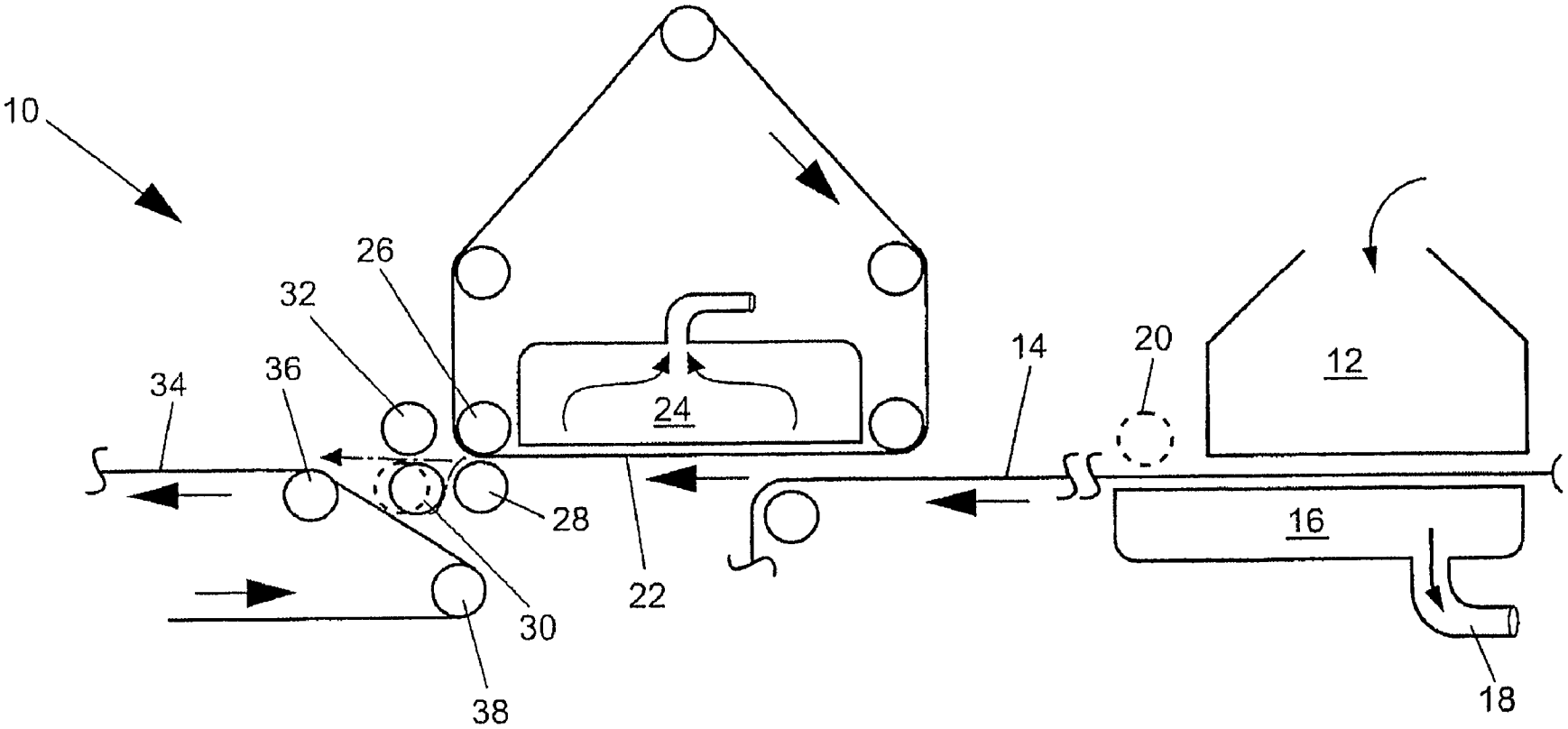
FIG. 1: shows a schematic side view of a section of an apparatus for producing non-woven, fleece-like fiber products.

The schematic representation in FIG. 1 of part of an apparatus 10 for producing non-woven, fleece-like fiber products shall be used to explain the part of fiber product manufacture of interest here. The direction of transport is essentially from right to left, as indicated by arrows.

A mixture of fibers to be processed by apparatus 10—possibly of different kinds—and possible other elements of the desired fleece are fed in pre-dosed form to a forming head 12. The function of forming head 12 is to achieve the maximum possible separation of fibers, maximum uniformity of distribution of the fibers and any additional elements of the fleece on a forming belt or forming sieve 14.

Forming belt 14 is embodied like a sieve and is therefore permeable to air. It transports the fibers as a fiber-air mixture, placed as uniformly as possible on forming belt 14, in the direction of transport from right to left, as indicated by the arrow. The fibers or fiber-air mixture is sucked against forming belt 14 by a suction box 16 mounted under forming belt 14. Suction box 16 is therefore open at the top and is provided with a connecting pipe 18 for extracting air.

Downstream from forming head 12, viewed in the direction of transport, a compacting roller 20 may be provided for the purpose of pre-compacting the fiber-air mixture on forming belt 14 by displacing part of the air out of the fiber-air mixture.

In the region of the left-hand end of forming belt 14, a transfer belt 22 is disposed just above forming belt 14. Transfer belt 22 is embodied like a sieve, similar to forming belt 14, and is used to receive the fiber-air mixture from forming belt 14. In order to take the fiber-air mixture from forming belt 14, a second suction box 24 is disposed above transfer belt 22. This suction box enables the fiber-air mixture to be transported "upside down" by means of transfer belt 22.

Transfer belt 22 conveys the fiber-air mixture to a roller arrangement comprising four rollers 26, 28, 30 and 32, of which a first roller 26 also serves as a deflecting roller for transfer belt 22 and forms with a second roller 28 arranged below the first roller 26 a first pair of rollers disposed one above the other.

The first pair of rollers arranged one above the other 26, 28 forms a first nip between said rollers, with a horizontal feeding direction, in which the fiber-air mixture is further compacted.

The nip formed by the first pair of rollers 26, 28 arranged one above the other can be adjusted in respect of the nip size and the nip pressure prevailing in the nip. To this end, the position of the first roller 26 can be adjusted in a direction that is at least approximately vertical.

The first roller 26 serving as a deflecting roller is preferably embodied as a roller having an elastic outer surface (rubber roller). The second roller 28 can then be embodied as an embossing roller having a smooth or structured steel surface.

The roller arrangement 26, 28, 30 and 32 provides two alternatives as regards further transport of the nonwoven fabric or fiber-air mixture exiting from the first nip.

A first transport path is represented in FIG. 1 by a broken line and leads, starting from the first nip, through the gap between the second roller 28 and the third roller 30 to a conveyor belt 34. The second roller 28 and third roller 30 together form a pair of adjacently arranged rollers that includes a nip with vertical feeding direction therebetween.

The advantage of this first transport path is that a relatively large area of the fiber-air mixture exiting from the first nip is supported over an approximately 90° section of the outer surface of the second roller 28. This is particularly advantageous in the case of fiber-air mixtures with low tensile strength.

In addition, the second roller 28 can be heatable. This results, in the case of the first transport path with the relatively large support surface for the fiber-air mixture on the second roller 28, in a large area for transferring heat from the second roller 28 to the fiber-air mixture.

In the nip formed by the pair of adjacently arranged rollers 28 and 30, the fiber-air mixture is further compacted and then placed on a rising section of conveyor belt 34. The fiber-air mixture is preferably guided around a large angular section of the third transport roller 30, such that the large contact area enables efficient transfer of additional heat from the third roller to the fiber-air mixture.

Thus, the third roller 30 can preferably and likewise be heated.

Alternatively or additionally, the third roller 30 may also be embodied as a roller with controllable deflection. In a known roller with controllable deflection, the rotational axis can be deflected by a certain amount in order to set a corresponding nip or nip pressure profile. Due to rollers being mounted in the region of their two axial ends, the rotational axis of rollers without controllable deflection becomes deflected due to the bending moment caused by the nip pressure, resulting in a nip that is widest in the middle of the roller between the mountings.

In order to obtain a uniformly wide nip when applying a predefined nip pressure, at least one of the rollers in a roller pair can also be configured with crowning instead of controllable deflection, meaning that the roller has a diameter that increases from the axial ends towards the middle. The longitudinal section of such a roller thus has a slightly convex profile. Such cambered or crowned rollers are therefore an alternative to rollers with controlled deflection, in order to obtain a nip of the same width throughout even when the nip pressure is greater.

Figure 2:
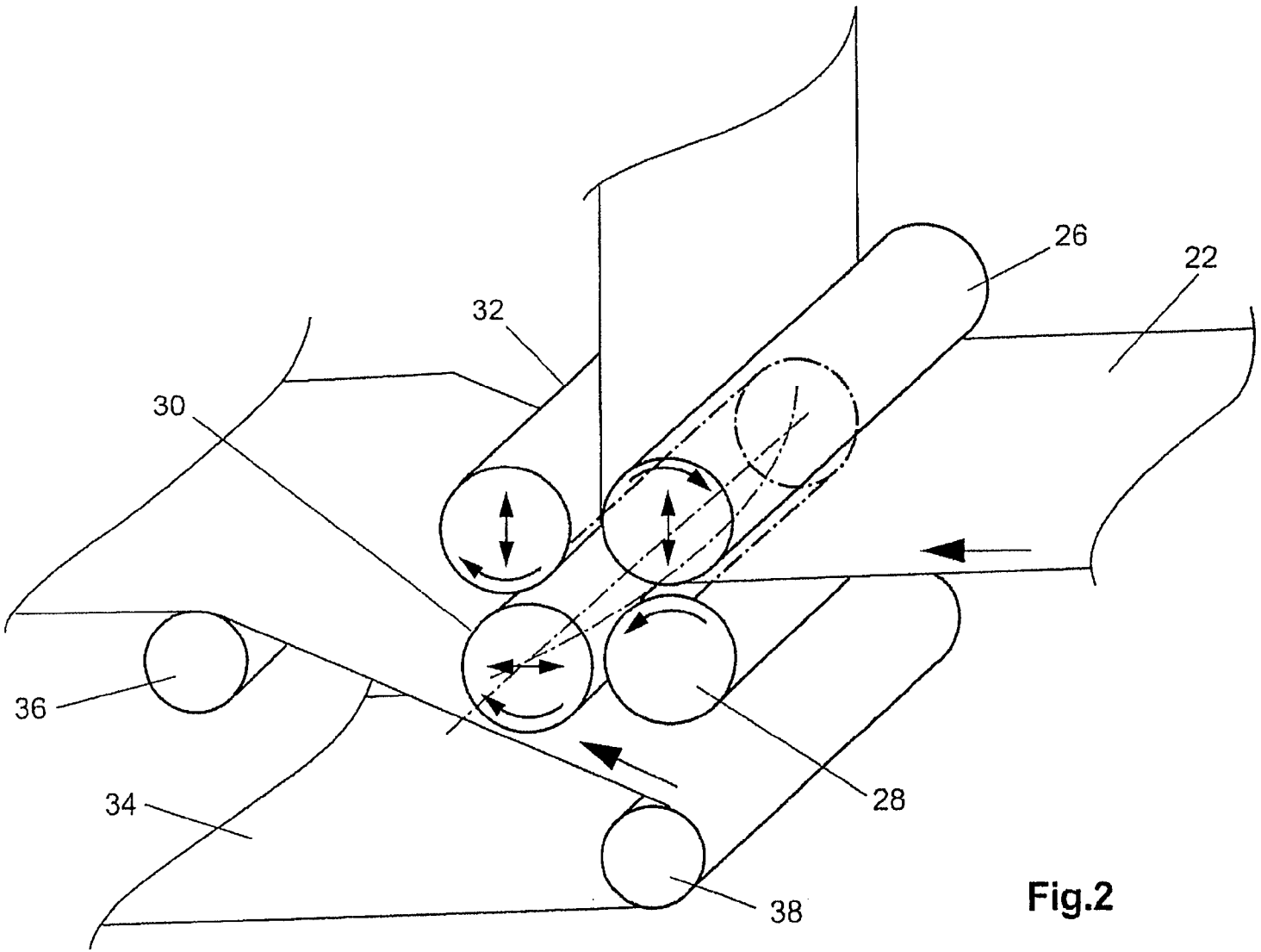
FIG. 2: shows a section of the apparatus in FIG. 1, in a schematic perspective view.

Since rollers 28 and 30 form a pair of adjacently arranged rollers in the case of the first transport path, and their axes of rotation lie in a plane that is approximately horizontal, the roller with controlled deflection should permit deflection in a horizontal plane in this case, as shown by the broken line in FIG. 2.

In order to compact the nonwoven fabric more strongly at a particular point or along a particular line and in this way to emboss a bonding structure onto the nonwoven fabric, the second roller may be embodied as an embossing roller with a structured outer surface provided with the corresponding raised portions and indentations. In the region of the raised portions of the outer surface of the second roller 28, the nonwoven fabric is compressed more strongly, thus resulting, in the case of simultaneous heat transfer, in the nonwoven fabric becoming more strongly compacted and more strongly bonded in the regions that are more strongly compressed.

A second, alternative transport path is shown in FIG. 1 by the dot-dash line and guides the fiber-air mixture exiting the first nip directly to a second nip formed between the third and fourth rollers as a nip with horizontal feeding direction, when the third and fourth rollers interact as a second pair of rollers arranged one above the other. Depending on the product being made, the second transport path may be advantageous. In particular, the fourth roller may be embodied as an embossing roller and have a structure on its outer surface that is different to that of the second roller 28, for example.

It is advantageous, in the case of the second transport path as well, if the third roller 30 is embodied as a roller with controlled deflection. Since the third roller 30 and the fourth roller 32 then form a pair of rollers arranged one above the other, the plane in which the rotational axis of the third roller is deflected is preferably vertical in orientation.

Since the roller arrangement comprising rollers 26, 28, 30 and 32 is to permit the first and alternatively the second transport path, it is advantageous if the deflection plane can be selectively set, in the case of a third roller 30 with controllable deflection, such that this plane is horizontal in orientation (for the first transport path) or vertical in orientation (for the second transport path).

To enable good transfer of heat into the nonwoven fabric in the case of the second transport path, the fourth roller 32 is preferably heatable as well.

To enable the desired reconfiguration between the first and second transport paths, the third roller 30 is mounted horizontally and transversely displaceable in respect of its rotational axis. In this manner, the third roller 30 can be spaced apart from the second roller 28 if the third roller 30 is to form a pair of rollers arranged one above the other with the fourth roller 32. In this case, due to the direction of rotation then required for the third roller, it is essential that the second and third rollers do not interact.

In the case of the configuration according to the second transport path, air nozzles can be provided above or below or above the transport path between the first pair of rollers 26, 28 arranged one above the other and the second pair of rollers 32, 30 arranged one above the other. These air nozzles can generate an upwardly directed stream of air extending across the entire width of the transport path, in order to support the loose nonwoven fabric on the second transport path between the first pair of rollers 266, 28 arranged one above the other and the second pair of roller 32, 30 arranged one above the other.

Such horizontal displaceability on the part of the third roller also enables a suitable nip or nip pressure to be set between the second roller 28 and the third roller 30, when these interact as a pair of adjacently arranged rollers in the case of the first transport path.

Finally, it is preferable for the fourth roller 32 to be transversely displaceable in a vertical direction relative to its rotational axis, in order to adjust the nip or the nip pressure in the case where the third and the fourth rollers interact as a second pair of rollers arranged one above the other (the second transport path).

Finally, conveyor belt 34 may also be reconfigurable in design, so that an upper deflecting roller 36 can be moved close to the third roller 30 when the second transport path is chosen. To this end, it is usually necessary to displace a lower deflecting roller 38 for conveyor belt 34 as well, so that conveyor belt 34 does not contact the third roller 30 and remains tensioned at the same time. Since the rising belt section of conveyor belt 34 runs perpendicular in that case, for example, it would not be appropriate to receive nonwoven fabric below a nip formed between the second roller 28 and the third roller 30, if the first transport path is chosen. It is therefore advantageous if the course of conveyor belt 34 can be reconfigured between two different configurations.

What is claimed is:

1. Apparatus for producing nonwoven, fleece-like fiber products, said apparatus comprising a transfer belt configured to transport an intermediate product on the underside of the transfer belt to a roller arrangement, characterized in that the roller arrangement comprises four rollers with rotational axes that are approximately parallel to each other, of which one first roller is used as a deflection roller for the transfer belt, of which one second roller is located underneath said first roller and forms therewith a first pair of rollers arranged one above the other, of which one third roller is located downstream from the second roller, viewed in the running direction of the transfer belt and of which one fourth roller is located downstream from the first roller, viewed in the running direction of the transfer belt, wherein the four rollers can be displaced relative to each other transversely to their rotational axis in such a manner that a nip for handling a nonwoven fabric can be selectively set either between the second and the third rollers such that the second and the third rollers form a pair of adjacently arranged rollers and include one nip for substantially vertical fleece transport, or between the third and the fourth roller such that the third roller and the fourth roller positioned above it form a second pair of rollers arranged one above the other and include another nip for substantially horizontal fleece transport.

2. The apparatus according to claim 1, characterized in that at least one nip can be adjusted by slight relative skewing of the rotational axes of respective rollers in a respective roller pair forming the at least one nip.

3. The apparatus according to claim 2, characterized in that a nip formed by the first roller pair arranged one above the other can be changed by adjusting the gap between the rotational axes of the first and second rollers.

4. The apparatus according to claim 3, characterized in that a nip pressure prevailing in the nip formed by the first roller pair arranged one above the other can be adjusted in a range between 0 and 150 N/mm.

5. The apparatus according to claim 1, characterized in that the one nip formed by the second and third rollers arranged as the pair of rollers adjacent to one other can be adjusted by changing the gap between the rotational axes of the second and third rollers.

6. The apparatus of claim 5, characterized in that the rotational axis of the third roller is transversely displaceable in a plane that is at least approximately horizontal.

7. The apparatus according to claim 1, characterized in that the gap between the rotational axis of the fourth roller and the rotational axis of the third roller can be adjusted.

8. The apparatus of claim 7, characterized in that the rotational axis of the fourth roller is transversely displaceable in a plane that is at least approximately vertical.

9. The apparatus according to claim 8, characterized in that at least one of the rollers is configured as a roller with controlled deflection or as a roller with variable cambering or, such that it is possible to change the shape of the nip or the nip pressure profile in the axial direction of the nip between the first roller pair arranged one above the other.

10. The apparatus according to claim 9, characterized in that the third roller is configured as a roller with controlled deflection such that the deflection is selectively possible in a horizontal plane or in a vertical plane.

11. The apparatus according to claim 1, characterized in that either the second roller or the fourth roller or both rollers are embodied as embossing rollers and have an outer surface provided with indentations and/or raised portions corresponding to the desired embossing pattern.

12. The apparatus according to claim 11, characterized in that one or more of the rollers has an outer mantle made of metal.

13. The apparatus according to claim 1, characterized in that the first roller or the third roller or both rollers are embodied as plain rollers with a smooth outer mantle.

14. The apparatus according to claim 1, characterized in that the first roller or the third roller or both rollers have a plastic covering that forms the outer mantle.

15. The apparatus according to claim 1, characterized in that the second, the third or the fourth roller or a plurality of said rollers have a heatable outer mantle.

16. The apparatus according to claim 1, characterized in that a transport belt is positioned downstream from the third roller, viewed in the feed direction of the transfer belt, said transport belt being configured to receive an intermediate product either below a nip formed between the second and the third roller, or downstream from a nip formed between the third and the fourth roller.

17. The apparatus according to claim 1, characterized in that a nip formed by the first roller pair arranged one above the other can be changed by adjusting the gap between the rotational axes of the first and second rollers.

18. The apparatus according to claim 1, characterized in that a nip pressure prevailing in a nip formed by the first roller pair arranged one above the other can be adjusted in a range between 0 and 150 N/mm.

19. The apparatus according to claim 1, characterized in that at least one of the rollers is configured as a roller with controlled deflection or as a roller with variable cambering or crowning, such that it is possible to change the shape of the nip or the nip pressure profile in the axial direction of the nip between the first roller pair arranged one above the other.

* * * * *